United States Patent [19]

Leuthold

[11] Patent Number: 4,522,387

[45] Date of Patent: Jun. 11, 1985

[54] DEVICE FOR STACKING SHEET-SHAPED OBJECTS

[75] Inventor: Karl Leuthold, Munich, Fed. Rep. of Germany

[73] Assignee: GAO Gesellschaft fur Automation und Organisation GmbH, Fed. Rep. of Germany

[21] Appl. No.: 521,724

[22] Filed: Aug. 9, 1983

[30] Foreign Application Priority Data

Aug. 31, 1982 [DE] Fed. Rep. of Germany ..... 3232348

[51] Int. Cl.[3] ..... B65H 29/00

[52] U.S. Cl. ..... 271/187; 271/209; 271/315

[58] Field of Search ..... 271/187, 315, 209

[56] References Cited

U.S. PATENT DOCUMENTS

| | | | |
|---|---|---|---|
| 3,162,438 | 12/1964 | Perry | 271/187 |
| 4,088,314 | 5/1978 | Phillips | 271/315 X |
| 4,228,997 | 10/1980 | Schoonmaker | 271/315 |

*Primary Examiner*—Richard A. Schacher

*Attorney, Agent, or Firm*—Steele, Gould & Fried

[57] ABSTRACT

A device for stacking sheets comprises several disks arranged adjacent to each other on a driving shaft, the disks having spiral slots running from the outside towards the inside. The spiral slots of the disks overlap in an axial direction and together form a pocket into which the sheet conveyed. In order to guarantee trouble-free stacking of the sheets, the spiral slots of adjacent disks are staggered at least in the inner area of the stacker. Therefore, almost all the kinetic energy of a sheet which is inserted into the slot is dissipated by frictional engagement and flexing. The spiral slots of one or more disks may additionally be provided with elastic boundary walls.

6 Claims, 7 Drawing Figures

DEVICE FOR STACKING SHEET-SHAPED OBJECTS

BACKGROUND OF THE INVENTION

The present invention relates to a device for stacking sheet-shaped objects making use of several disks arranged adjacent to each other on a driving shaft, these disks having spiral slots running from the outside towards the inside, the slots overlapping in an axial direction together forming a pocket into which the objects are fed singly by a transport system.

2. Prior Art

Automatic sorters for sorting sheet-shaped objects, for example vouchers, must be able to process great quantities in as short a period as possible, which necessarily involves high transport speed. The higher the transport speed is, the more problematic it is to process the sheets, for example to stack them after the sorting process, for this requires the sheets to be brought to a full halt within a short time and on a short path.

German Auslegeschrift No. 12 48 561 describes a spiral slot stacker in which two disks rotating around a common axle and having spiral slots formed therein running from the outside towards the inside are arranged adjacent to one another. The slots overlap each other axially in the disks and together form a pocket into which a sheet is introduced tangentially. The sheets are removed from the pockets by aid of a pick-off arranged between the disks. The peripheral speed of the disks is considerably lower than the transport speed of the sheets so that the surface of the sheet, when it is running in, slides along the outer boundary walls of the spiral slots, causing friction. The frictional force resulting from this relative movement slows down the sheet. The centrifugal force which takes effect as a result of the deflection into a spiral path further increases the pressure of the sheets against the corresponding boundary walls, which also increases the friction, depending on the speed. However, the slow-down has proved to be insufficient, even when the stacking device is provided with several spiral disks for increasing the effictive friction surface. Sheets, especially the more rigid ones, hit the ends of the spiral paths or the pick-off at speeds which are still too high, and fequently rebound. The sheet may leave the pocket too soon in the process, which necessarily leads to a disturbance in the stacking process. When sheets with a soft, flabby quality hit the ends of the spiral paths or the pick-off at speeds which are too high, an accordion-like deformation is possible, especially in the leading area of the sheets. This may often lead to damage or at least to imprecise orientation during stacking.

SUMMARY OF THE INVENTION

The invention is thus directed to solving the problem of providing a spiral slot stacker allowing for trouble-free stacking more or less independently of the condition of the sheets and their speed.

The problem is solved by a device for stacking sheet-shaped objects, comprising a driving shaft and a plurality of disks arranged adjacent to each other on the driving shaft. The disks have spiral slots running from the outside towards the inside thereof, the slots of respective disks overlapping one anther in an axial direction, overlapping slots together forming a pocket into which the objects may be fed singly by a transport system. At least one of the spiral slots forming each pocket is staggered relative to another of the spiral slots, at least in an inner area of their length. In one embodiment, the spiral slots of at least one of the disks have a spiral curvature differing from the spiral curvature of the other disks. In another embodiment, the disks are identical to one another, but at least one of the disks is rotationally staggered at a certain angle on the driving shaft relative to the other disks. In a further alternative embodiment, at least one of the disks has spiral slots provided with elastic boundary walls. The elastic boundary walls may be formed by a tongue cut out of the disk material and extending into the spiral slot or may be formed by a plate spring disposed in the spiral slot.

The design of the pockets according to the invention assures that almost all the kinetic energy of a sheet is dissipated by frictional engagement and flexing even before the leading edge of the sheet hits the end of the pocket. This greatly reduces the tendency of the sheets to bounce or rebound, especially more rigid ones. It also reduces the development of noise, which is caused in conventionally designed stackers when the sheet hits the end of the pocket or the pick-off. The soft slow-down and guiding of the sheet over a small area bring it to a halt in an unwrinkled state, so that even very soft, flabby sheets can be processed without any trouble.

Due to the staggering of the spiral slots and their rigid design, the sheet is additionally impressed with a wavy cross-section at right angles to the spiral curvature, which may cause the sheets to be wedged in the stacker when the staggering is too great. In such a case, very unstable, flabby sheets might not be ejected smoothly out of the spiral pocket, although the slowing down process for the sheets running in is not interfered with.

As will be shown below in connection with an advantageous development of the invention, it is nevertheless possible to make the staggering of the spiral slots relatively great without running the risk that the sheet is wedged. This is achieved by giving at least one boundary wall of a spiral slot an elastic design so that it can be pressed back by the sheet running in. This increases the counter pressure on the sheet, as well as the effective frictional force within the spiral pocket, without there being any fear that the sheet be too greatly wedged in.

BRIEF DESCRIPTION OF THE DRAWINGS

Further advantages and developments of the invention can be seen in the preferred embodiments, which shall be described hereinafter with reference to the figures, wherein.

DETAILED DESCRIPTION OF THE PREFERRED EMBODIMENTS

Figure 1:
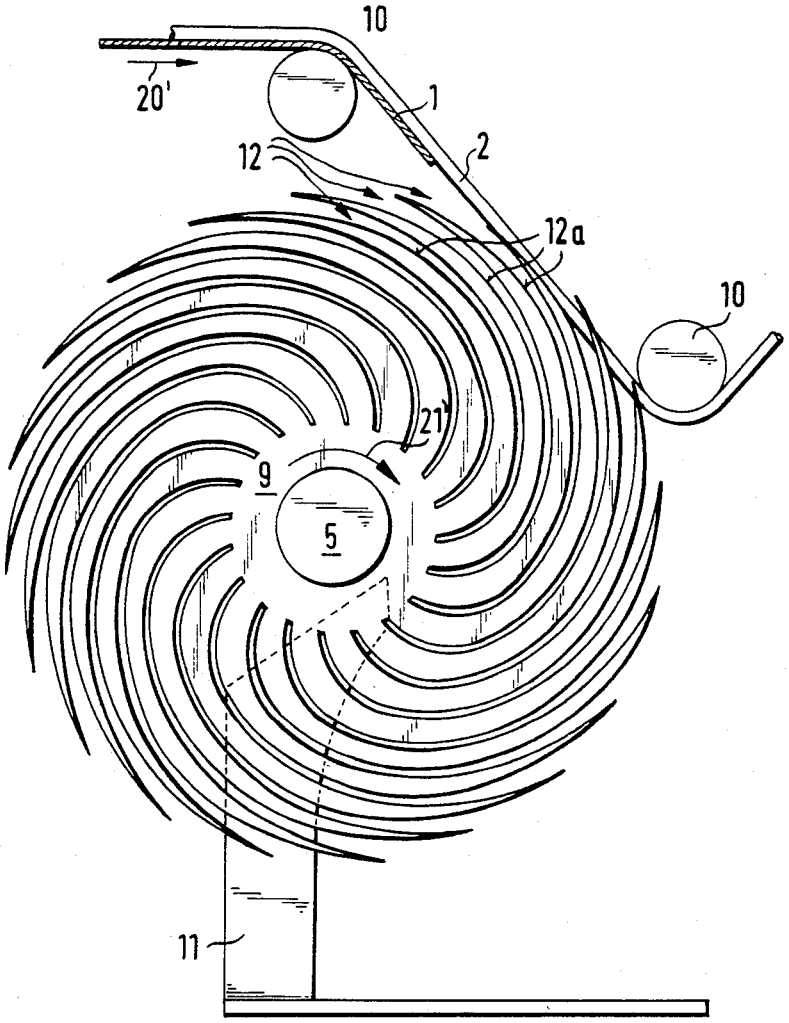
FIG. 1 is a side elevation showing the basic construction of a spiral slot stacker.

The basic mode of operation and the construction of a stacker shall be explained with reference to FIG. 1. Sheets 1 are fed in rapid sequence in the direction of arrow 20 by a transport system comprising conveyer belts 2 and transport rollers 10 to the spiral slot stacker rotating in the direction of arrow 21. The stacker comprises several disks 5 attached to shaft 9 at a distance from each other at right angles to the drawing plane in FIG. 1. Each disk is provided with slots 12 running spirally towards the middle of the disk. The various disks are attached to the shaft in such a way that the slots of adjacent disks overlap, when regarded axially. Those slots overlapping with each other together form a spiral pocket. Inside a pocket, the sheet slides along the outer boundary 12*a* of a spiral slot. When the spiral slot disks continue rotating, the sheets are removed from the spiral pockets by a pick-off 11 arranged between the disks, and stacked on a tray 4.

In conventional spiral slot stackers, only the frictional forces acting between sheet 1 and outer boundary wall 12*a* of a spiral slot 12 contribute to slowing down the sheets. The centrifugal force also has a certain effect due to the additional counter pressure.

According to the inventive solution, the sheet is contacted and slowed down on both sides, i.e. both by the outer and by the inner boundary walls of the slots. This grasping on both sides can be realized in several ways, as described in the following.

Figure 2:
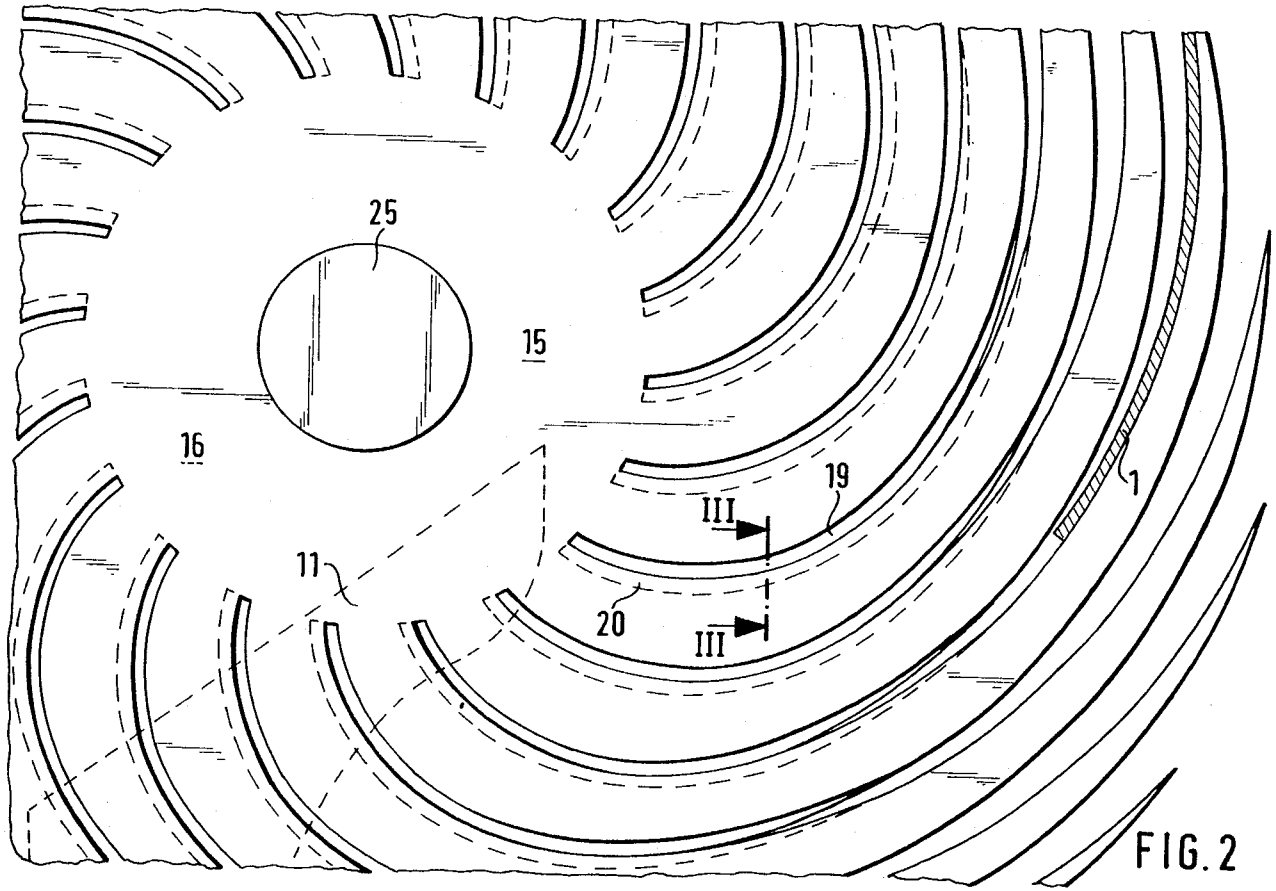
FIG. 2 is a partial side elevation of a spiral slot stacker in which the spiral slots of the disks are staggered.
Figure 3:
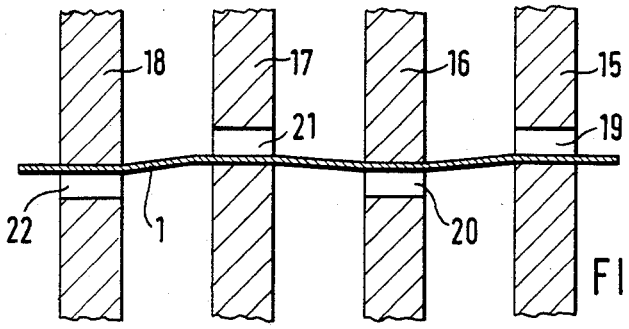
FIG. 3 is a section view taken along line 3—3 of FIG. 2.

In a first embodiment, two different types of disks are used, which are attached to a driving shaft in a multipledisk arrangement, i.e. in an alternating sequence. As shown in FIG. 2, and FIG. 3 in cross-section, four disks 15, 16, 17, and 18 are attached to shaft 25. Two pairs of disks 15 and 17, and 16 and 18, are each constructed identically. The pairs of disks differ by the radius of curvature of the spiral slots. In the example shown, spiral slots 19 and 21 of disks 15 and 17 have increased curvature in approximately half of the spiral slot length towards the center of the disks relative to slots 20 and 22 of disks 16 and 18. As shown clearly in FIG. 2 as well, the spiral slots of all disks overlap (are aligned) in the outer area of the stacker drum, whereas, they diverge gradually from one another towards the middle of the stacker drum. A sheet can thus run into the spiral pocket assigned to it without being obstructed, since the entry points of the spiral slots overlap each other congruently. Later, the effect. It makes both sides of the sheet come in contact with the boundary walls of the spiral slots (see FIG. 3), so that the sheet is slowed down by the frictional forces acting on both sides of it. An increase in the staggering leads to and increase in these frictional forces since the sheet additionally acquires a wavy cross-section at right angles to the spiral curvature. This wavy cross-section, which is increasingly imposed as the sheet runs further in, and may be clearly seen in FIG. 3, increases the counter pressure of the sheet against the boundary walls of the spiral slots. The frictional forces, and, therefore thus the slowing down effect thus increase continuously. The close guiding of the sheet, in combination with the wavy cross-section at right angles to the spiral curvature, assure that the sheet is brought to a full halt at the end of the spiral pocket, reliably and without being destroyed. The extent of the wavy-cross-section of the sheet is determined by the degree of staggering of the spiral slots and the distance between the disks. This allows for many possibilities of optimally adapting the embodiment of the spiral pocket arrangement to the particular conditions at hand. This spectrum of possible embodiments also includes the design of the increase in the degree of staggering and the selection of the point of effective staggering, allowing for the extent of the slowing down effect and also the slowing down path to be adapted to the particular conditions at hand.

The contact between both sides of the sheets and the boundary surfaces of the spiral slots may also be realized with identical spiral pocket disks whose slot openings taper from the outside towards the inside. In this arrangement, at least one of the disks is mounted on the driving shaft rotationally staggered at a small angle. This angle of displacement is selected in such a way that the openings of the spiral slots no longer overlap in the inner area of the disk. As in the embodiment described above, the sheet is additionally curved at right angles to the spiral curvature.

Figure 4:
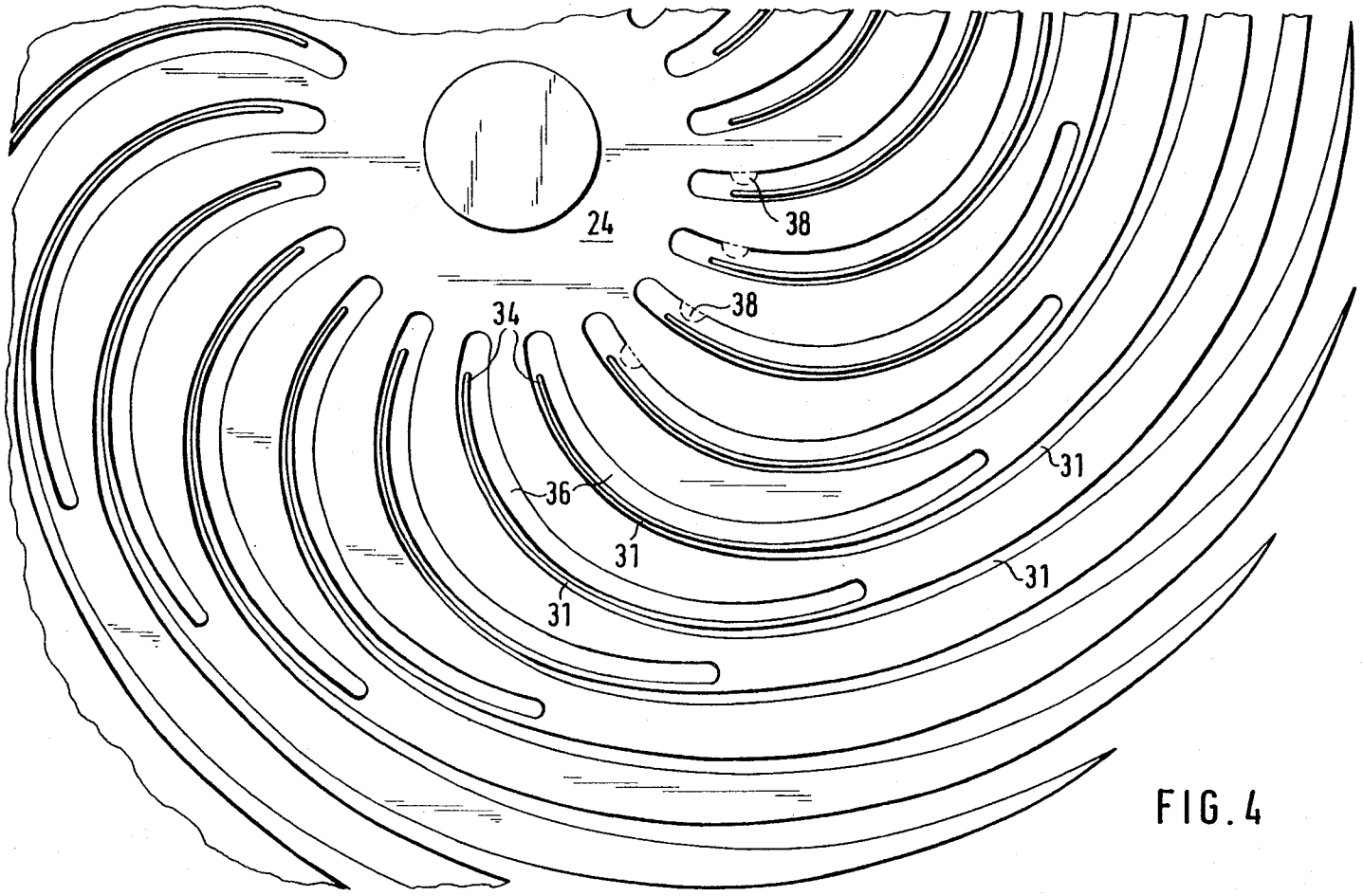
FIG. 4 is a partial side elevation of a disk of a spiral slot stacker, having spiral slots with an elastic design.

In the following, an embodiment of the invention shall be described which, as mentioned at the outset, allows for greater staggering of the spiral slots of a stacker without the ejection of the sheets being interfered with. In this stacker a disk type is used as shown in FIG. 4.

Spiral slots 31—designed in the outer area as in the disks described above—exhibit, for about half of the spiral length extending towards the middle of the disk, an elastic boundary wall which is cut out of the material of the disk in the form of a tongue 34. A free space 36 is also cut out of the disk material, one being assigned to each spiral slot 31, for the tongue to be pressed into. This may take place, for example, when a sheet is thicker then the spiral slot in the area of the tongue, or else, as shown below, due to the staggered arrangement of the spiral slot of a second disk.

Figure 6:
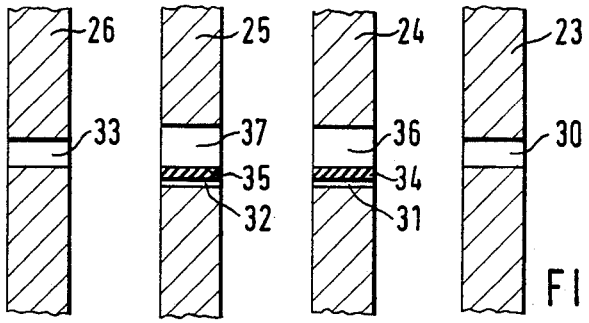
FIG. 6 is a section view taken along line 6—6 of FIG. 5.
Figure 7:
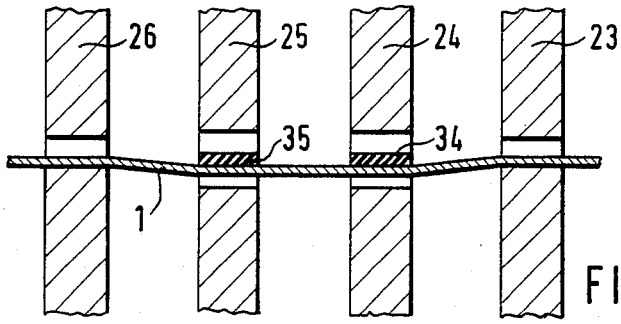
FIG. 7 is a section view taken along line 7—7 of FIG. 5.
Figure 5:
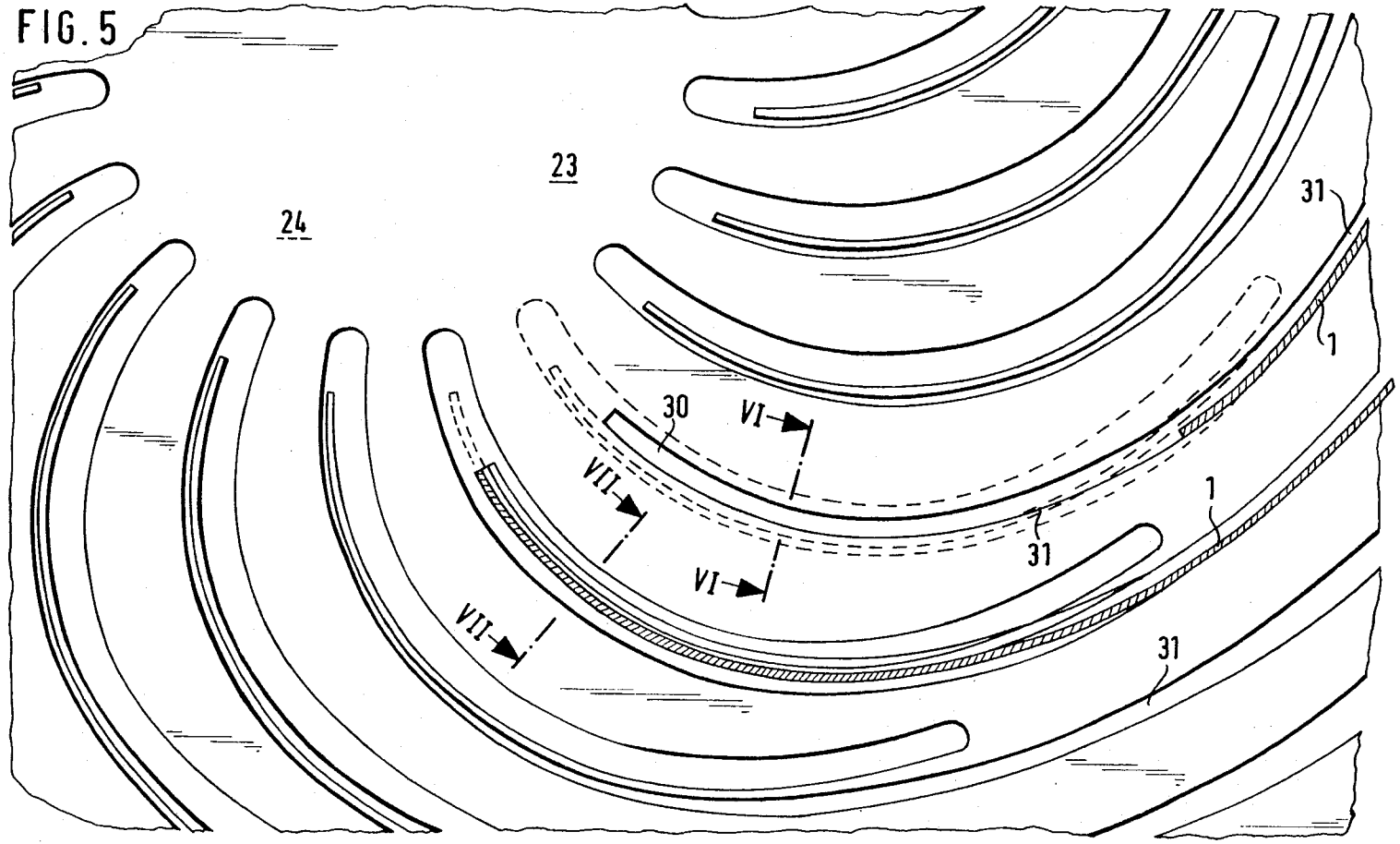
FIG. 5 is a partial side elevation of a spiral slot stacker embodying the disk shown in FIG. 4.

FIGS. 5, 6 and 7 show, with reference to an example, the mode of operation of a stacker having elastically designed spiral slots, FIGS. 6 and 7 showingg cross-sectional views of FIG. 5 along lines 6—6 and 7—7, respectively. The stacker comprises disks 23, 24, 25 and 26, but only disks 23 and 24 (broken lines) are shown in FIG. 5 for the sake of clarity. The two inside disks 24 and 25 are provided in this embodiment with elastic elements or tongues 34, 35, greatly narrowing spiral slots 31, 32 of these disks in the area of the tongues. Above the tongues, as shown in FIGS. 6 and 7, these are free spaces 36, 37 into which tongues 34, 35 may be moved. The two outside disks 23, 26 have an identical construction to that of the disks described in the preceding embodiment.

In the spiral slot stacker with elastic boundary walls, the spiral slots of adjacent disks also overlap in the area of the stacker where the sheets run in (see FIG. 5 spiral slots 31, 30). Towards the middle of the disk, however, spiral slots 31, 32 of inside disks 24, 25 are greatly staggered with respect to the outside disks, so that a sheet running in is forced to press back the elastic boundary walls or tongues 34, 35, as shown in FIGS. 5 and 7.

Although the staggering of spiral slots 31, 32 and 30, 33 is relatively great and the sheet can therefore be slowed down reliably and without being wrinkled, it must not be feared that the sheet be wedged in by the elastically designed boundary walls, possibly obstructing its ejection. As shown in FIG. 5 by the example of disks 23, 24, spiral slots 30 of disk 23 come to an end before the end of spiral slots 31 of disk 24 provided with tongues 34. This prevents the sheets from advancing to the freely mobile end of a tongue where they could be caught.

In the embodiment described, the outgoing end of each tongue is freely mobile. It is possible to increase the resistence of a tongue with respect to a sheet which is running in by limiting the freedom of movement of the outgoing end of a tongue by a correspondingly designed abutment 38. In FIG. 4 an embodiment of this variation is shown by broken lines. Abutment 38 may further increase the slowing down force acting upon a sheet running in.

The elastic boundary walls or tongues are cut out of the material of the disk in the embodiment described. However, it is of course also possible to use disks with the usual spiral slots and then insert metal springs, for example, into them.

I claim:

1 (amended). A device for stacking sheet-shaped objects, *comprising:* [making use of severall] *a plurality of* disks arranged adjacent to each other on a driving shaft, said disks having spiral slots running from the outside towards the inside *thereof,* the slots *of respective disks* overlapping *one another* in an axial direction, *overlapping slots* together forming a pocket into which the objects *may be* [are] fed singly by a transport system, *at least one of said* [characterized in that those] spiral slots *forming each* [(19, 20, 21, 22, 30, 31, 32, 33) which form a] pocket [are] *being* staggered *relative to another of said spiral slots* at least in an area of their length.

2 (amended). A device [for stacking sheet-shaped objects] as *recited* in claim 1, *wherein* [characterized in that] the spiral slots [(19)] of at least one *of the disks* [disk (15)] have a spiral curvature differing from *the spiral curvature* [that] of the other disks [(16, 18)].

3 (amended). A device as *recited* in claim 1, *wherein the disks are provided with identical slots, and* [characterized in that] at least one *of the disks* [disk] is rotationally staggered at a certain angle *on the shaft relative* [with respect] to the other [identical] disks on the shaft.

4 (amended). A device as *recited* in claim 1, *wherein at least one of the disks has* [characterized in that the] spiral slots [of at least one disk] provided with elastic boundary walls.

5 (amended). A device as *recited* in claim 4, *wherein each of* [characterized in that] the elastic boundary *walls* [wall] is formed by a tongue [(34)] cut out of the disk material and extending into the spiral *slot* [path (31)].

6 (amended). A device as *recited* in claim 4, *wherein each of* [characterized in that] the elastic boundary *walls* [wall] is formed by a plate spring *disposed* [attached to] the spiral slot.

* * * * *